United States Patent [19]

Fukuda et al.

[11] Patent Number: 4,622,733

[45] Date of Patent: Nov. 18, 1986

[54] BRANCH WIRE CONNECTING APPARATUS

[75] Inventors: Michio Fukuda; Toshifumi Okunishi; Eiji Fudo, all of Osaka, Japan

[73] Assignees: Sumitomo Electric Industries, Ltd.; Tokai Electric Wire Company Limited, both of Osaka, Japan

[21] Appl. No.: 573,404

[22] Filed: Jan. 24, 1984

[51] Int. Cl.[4] ..... H01R 43/04

[52] U.S. Cl. ..... 29/564.4; 29/748; 81/9.51

[58] Field of Search ..... 29/564.4, 33 M, 564.6, 29/564.8, 748, 747, 868, 872, 857, 861; 81/9.51

[56] References Cited

U.S. PATENT DOCUMENTS

| | | | |
|---|---|---|---|
| 2,976,895 | 3/1961 | Durham | 29/868 X |
| 3,570,100 | 6/1971 | Kindell et al. | 29/564.4 |
| 3,621,556 | 11/1971 | Thierri et al. | 29/564.4 X |
| 3,659,328 | 5/1972 | Klein | 29/564.4 X |
| 3,748,932 | 7/1973 | Neiman et al. | 81/9.51 |
| 3,769,681 | 11/1973 | Eubanks | 29/564.4 |
| 3,781,458 | 12/1973 | May | 29/868 X |
| 3,895,426 | 7/1975 | Papsdorf | 29/564.4 |
| 4,171,566 | 10/1979 | Tominoi | 29/748 |
| 4,348,805 | 9/1982 | Gibbons | 29/857 |
| 4,361,942 | 12/1982 | Mazzola et al. | 29/564.4 |
| 4,403,383 | 9/1983 | Dewhurst et al. | 29/33 M |
| 4,441,386 | 4/1984 | Hara | 29/564.4 X |
| 4,506,566 | 3/1985 | Schmid | 29/564.4 X |

*Primary Examiner*—William R. Briggs

*Attorney, Agent, or Firm*—Ernest A. Beutler

[57] ABSTRACT

Disclosed is an apparatus for connecting at least one branch electric wire to an intermediate portion of a main electric wire. The apparatus has a stripping section in which the intermediate portion of the main wire is stripped to expose its conductor, a solderless connecting section in which the main and branch wires are connected in a solderless manner by means of a connecting piece, and a taping section in which the connected wires are coated with insulating tape. The stripping section, solderless connecting section and the taping section are assembled on a frame three dimensionally to realize a compact apparatus which can perform a through process including to steps of stripping, solderless connection and taping. The apparatus further has a rotatable and extendable/retractable transportation hand means adapted to automatically transport and deliver the wires from the stripping section to the solderless connecting section and from the solderless connecting section to the taping section.

11 Claims, 7 Drawing Figures

BRANCH WIRE CONNECTING APPARATUS

FIELD OF THE INVENTION

The present invention relates to a branch wire connecting apparatus (referred to simply as "connecting apparatus", hereinunder) for attaining an automatic solderless connection of a branching electric wire to an intermediate portion of a main electric wire.

DESCRIPTION OF THE PRIOR ART

Generally, a solderless connection of a branch wire to an intermediate portion of a main wire essentially employs three steps of removing the coating from the intermediate portion of the main wire, i.e. stripping, connecting the branch wire to the main wire by means of connecting piece, and taping on the connecting portion of the wires. These steps have to be taken successively but independently employing different devices peculiar to such steps. Consequently, from the view point of the production efficiency, the prior art has encountered problems or difficulties which are usually experienced in a process having separate steps, e.g. an increase in the number of man-hour, stagnation of works, troubles concerning transportation, and so forth.

SUMMARY OF THE INVENTION

Accordingly, an object of the invention is to provide a connecting apparatus which can synthetically perform the three steps of stripping, solderless connection of the branch wire to the main wire and taping of the connecting portion of the wires so as to attain an automatic and continuous solderless connection of branch wires to main wires at a high yield, thereby to obviate the above-described problems of the prior art.

To this end, according to the invention, there is provided an apparatus for connecting at least one branch electric wire to an intermediate portion of a main electric wire, comprising: a stripping section disposed at the front middle portion of the apparatus, a solderless connecting section disposed at the rear upper portion of the apparatus, a taping section disposed at the rear lower portion of the apparatus, and a rotatable and stretchable transportation hand means adapted to automatically transport and deliver the wires from the stripping section to the solderless connecting section and from the solderless connecting section to the taping section.

The above and other objects, features and advantages of the invention will become clear from the following description of the preferred embodiment when the same is read in conjunction with the accompanying drawings.

DETAILED DESCRIPTION OF THE PREFERRED EMBODIMENT

A preferred embodiment of the invention will be described hereinunder with reference to the drawings.

Figure 1:
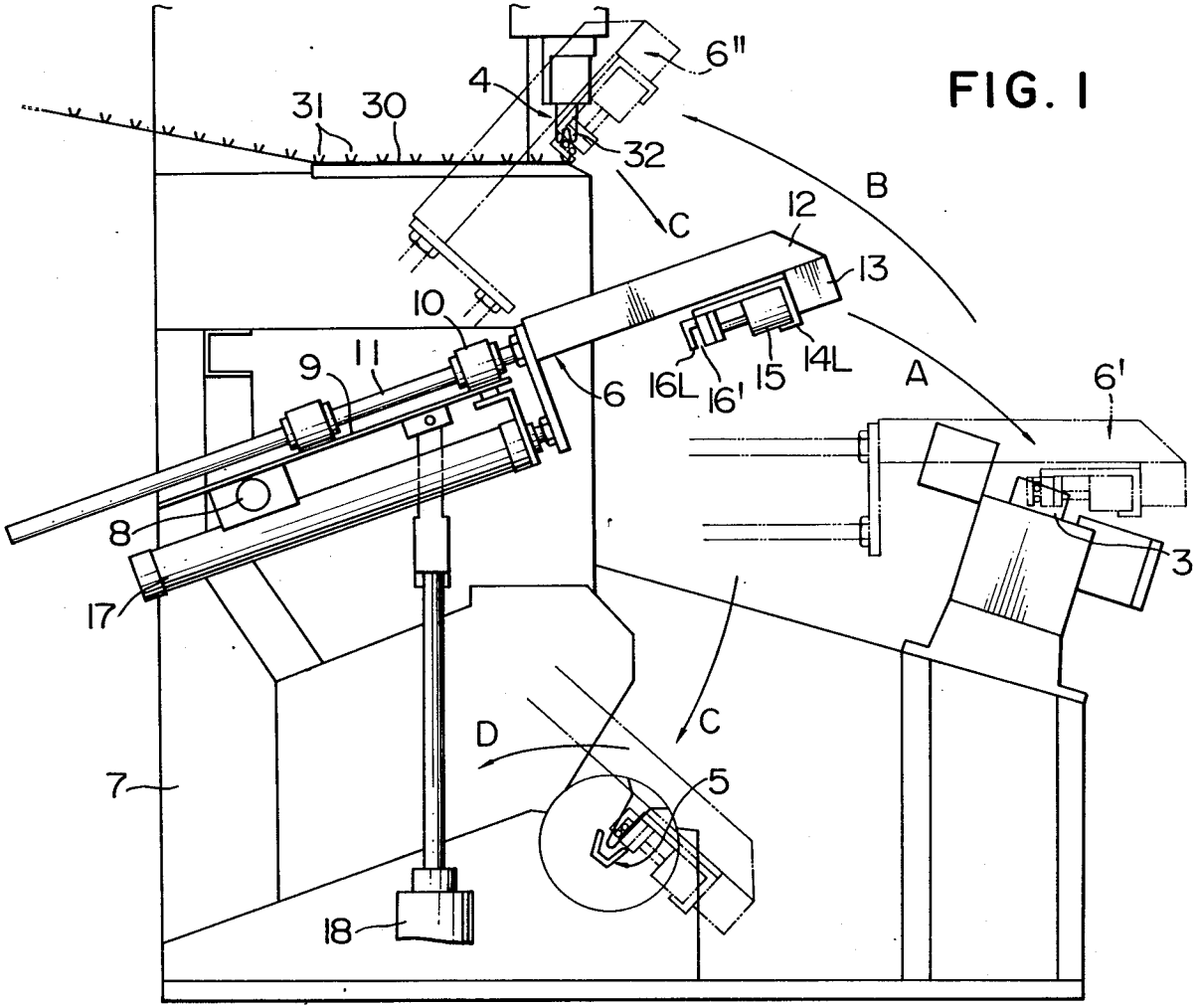
FIG. 1 is a side elevational view of a connecting apparatus embodying the present invention.
Figure 2:
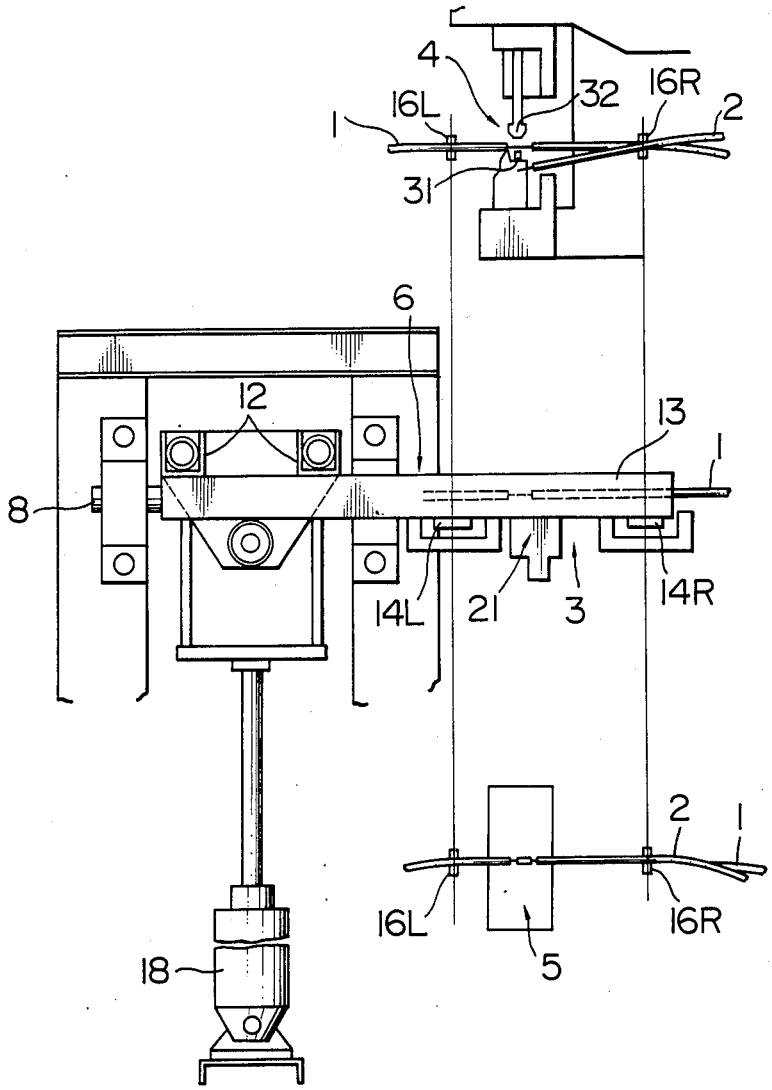
FIG. 2 is a front elevational view of the apparatus shown in FIG. 1.

Referring first to FIGS. 1 and 2, a connecting apparatus embodying the present invention has three sections: namely, a stripping section 3 adapted to strip and expose an intermediate portion of a main wire 1 to which a branch wire 2 is to be connected, a solderless connecting section 4 adapted to receive the main wire 1 and the branch wires 2 and to connect the latter to the former by means of a connecting piece, and a taping section 5 in which an insulating tape is wound around the connecting portion of the wires. These three sections 3, 4 and 5 are assembled three-dimensionally. More specifically, the stripping section 3 is disposed at the central front portion of the apparatus, the solderless connecting section 4 is disposed at an upper rear portion of the apparatus, and the taping section 5 is disposed at the rear lower portion of the apparatus. The connecting apparatus further has a transportation hand means 6 adapted to perform the transportation of the wires from one to the next sections.

More specifically, the transportation hand means 6 has a base plate 9 which is pivotally supported by a pivot shaft fixed to a rear portion of the apparatus frame 7 so as to extend forwardly therefrom, a shaft 11 slidably carried by bearings 10 on the base plate 9, a transfer arm 12 projected from the forward end of the shaft 11 and having a clamp arm 13 attached to the forward end thereof such that the arms 12 and 13 in combination present a substantially L-like form, and a pair of clamps 14R and 14L secured to the clamp arm 13. The clamps 14L and 14R have, respectively, L-shaped catches 16L and 16R which are operated by small-sized cylinders 15 so as to open and close openings 16' of the catches directed downwardly. The wires 1 and 2 are received and held by these openings when they are transported from the stripping section 3 to the solderless connecting section 4 and from the solderless connecting section 4 to the taping section 5. To explain in more detail, the transportation hand means 6 is adapted to be stretched and retracted by a pneumatic cylinder 17 attached to the lower side of the base plate 9 and also to be rotated by a pneumatic cylinder 18 mounted on the frame 7. The cylinders 17 and 18 are suitably activated to move the arm 6 to a desired position and, after the arm 6 is stopped at such a position, the left and right catches 16L and 16R operate to clamp and catch the wires 1 and 2 at two points spaced along the length of the wires.

Figure 3:
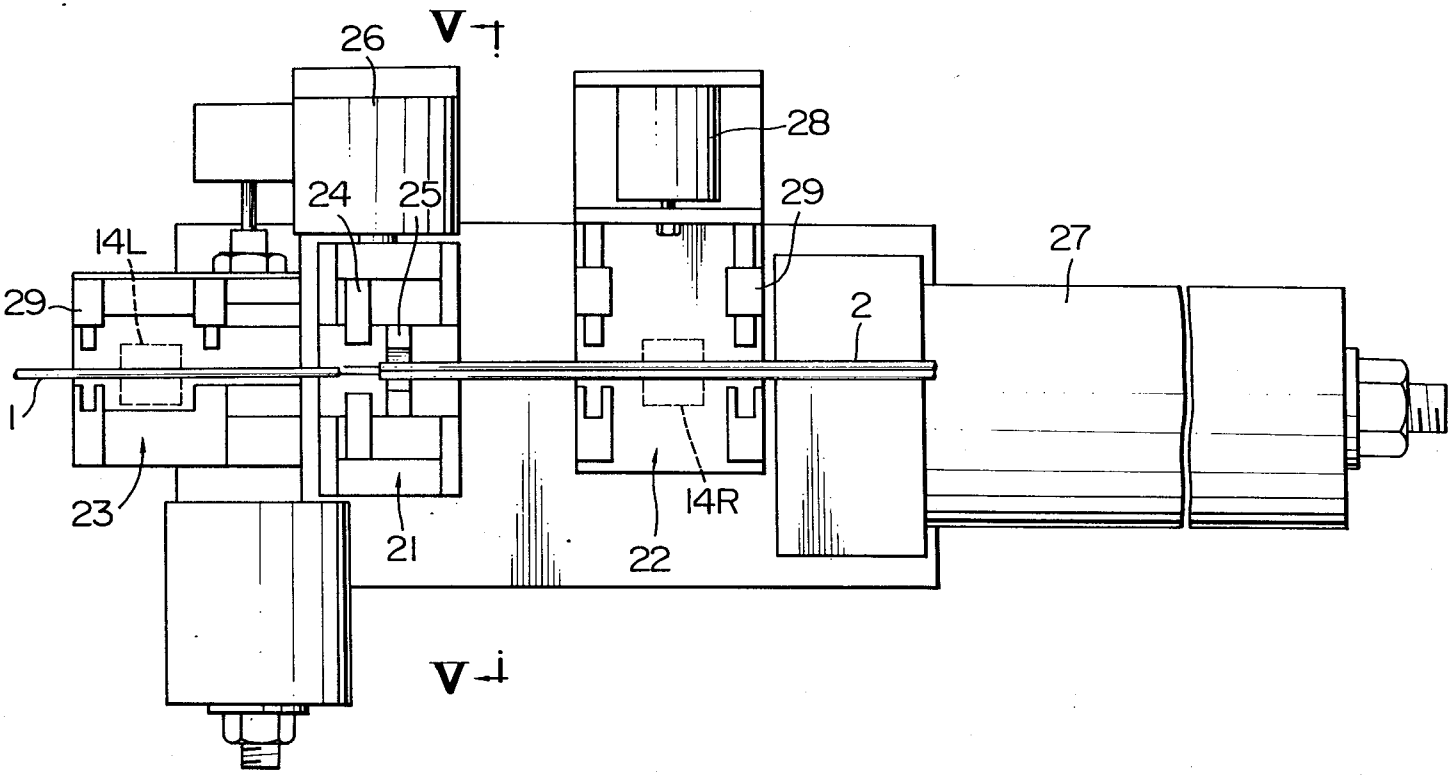
FIG. 3 is an enlarged plan view of a stripping section of the connecting apparatus shown in FIG. 1.
Figure 4:
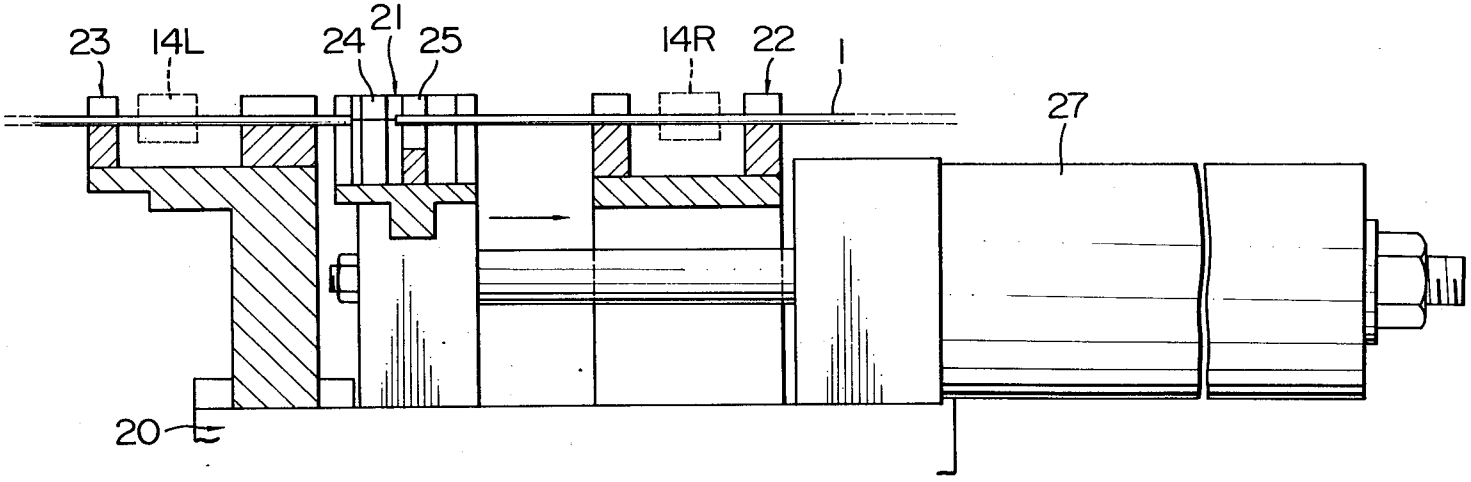
FIG. 4 is a front elevational view of a stripping section shown in FIG. 3.
Figure 5:
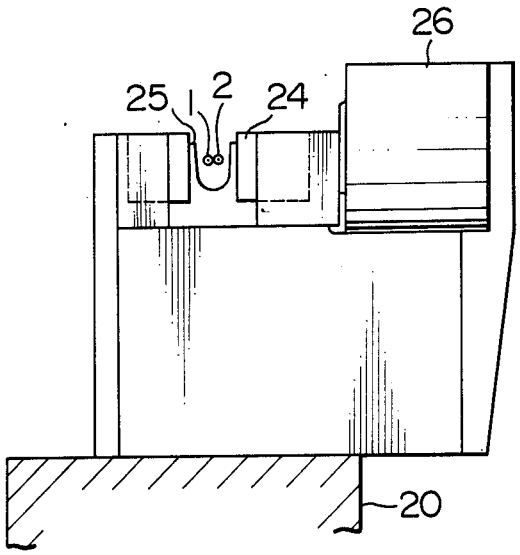
FIG. 5 is a sectional view taken along the line V—V of FIG. 3.

Referring now to FIGS. 3 to 5, the stripping section 3 has a stripper 21 mounted on a frame 20, and holders 22 and 23 disposed at both sides of the stripper 21. The stripper 21 includes cutting blades 24 which operates perpendicularly to the axis of the main wire 1 received thereby and a U-shaped detection groove 25. The stripper 21 is adapted to be moved slightly in the direction of axis of the main wire 1 by means of a pneumatic cylinder 27. In operation, the cutting blades 24 operate perpendicularly to the axis of the main wire 1 to cut only the coating and holds the main wire 1. Subsequently, the stripper 21 is moved slightly along the axis of the main wire so that the coating is severed and crimped to allow the conductor of the main wire 1 to be exposed partially. The holders 22 and 23 have fixing claws 29 which are operated by, for example, a pneumatic cylinder 28 so as to hold and fix the main wire 1 during the stripping thereby to assist the stripper 21. The detection groove 25 is associated with a detecting circuit adapted to detect any positional error of the branch wire 2 which is inserted into the groove 25 as will be explained later. A reference numeral 26 designates a pneumatic cylinder for operating the cutting blade 24.

Figure 6:
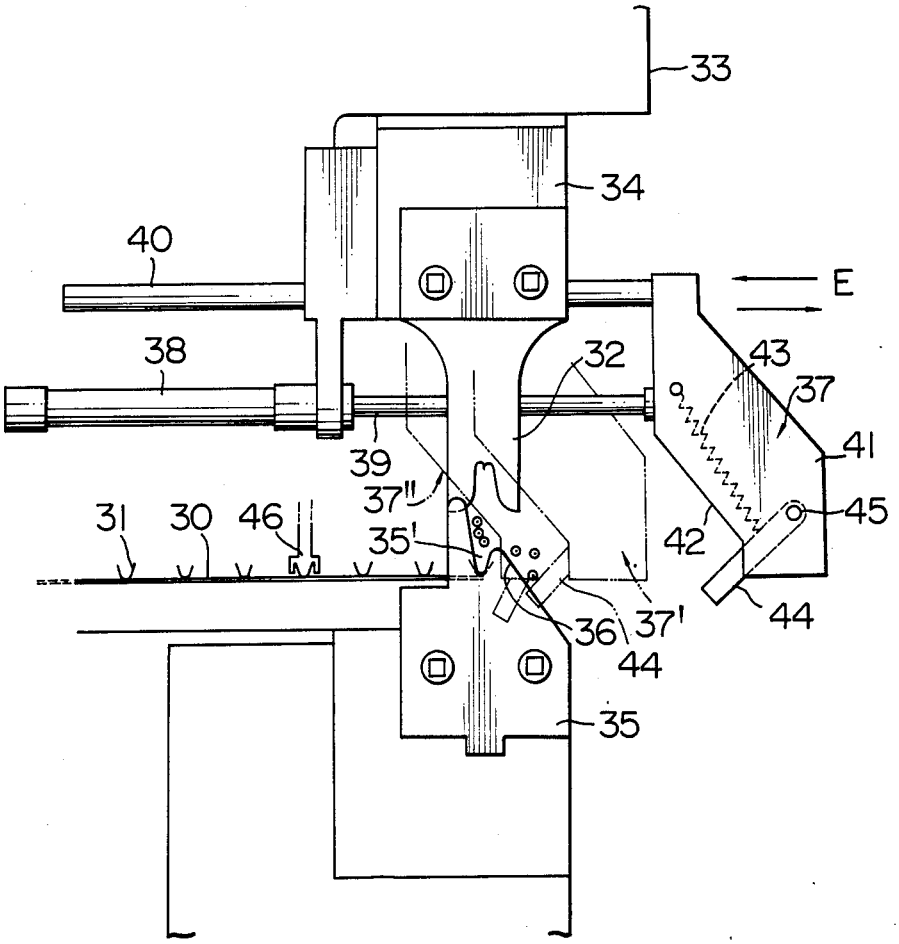
FIG. 6 is an enlarged side elevational view of a solderless connecting section of the connecting apparatus shown in FIG. 1.
Figure 7:
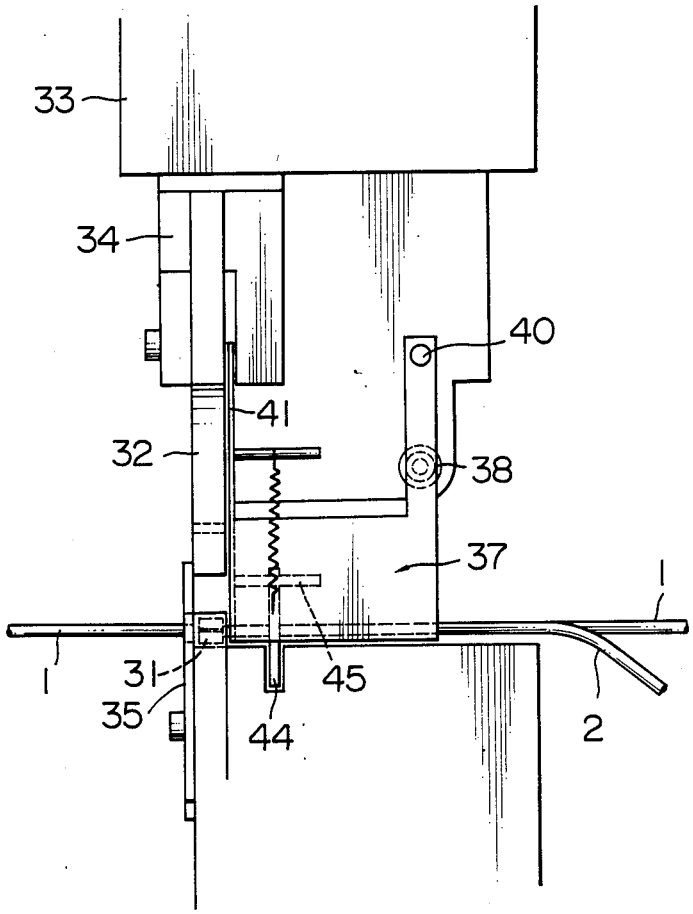
FIG. 7 is a right side view of FIG. 6.

Referring now to FIGS. 6 and 7, the solderless connecting section 4 is adapted to be successively supplied with U-shaped connecting pieces 31 which are connected in series by a connecting web 30. A press punch 32 is disposed just above the foremost connecting piece. The press punch 32 is attached to a press ram 34 mounted on the frame 33 so as to be driven up and down by the press ram 34. A guide plate 35 disposed below the press punch 32 has a guide groove 35' adapted to guide the wires 1 and 2 into the hollow of the U-shaped connecting piece. A wire gathering mechanism 37 is disposed in front of the press punch 33. The wires which have been moved to the positions near the forward tapered surface 36 of the guide plate 35 are correctly introduced to the position below the press punch 32 thereby to ensure a smooth and correct solderless connection of the wires. More specifically, the wire gathering mechanism 37 has a wire gathering plate 41 having a guide ramp 42 adjacent to the press punch 32, and a wire gathering rod 44 secured to a lower portion of the wire gathering plate 41 by means of a pivot pin 45. The wire gathering mechanism 37 is connected to the rod 39 of a pneumatic cylinder 38 mounted on the frame 33. As the pneumatic cylinder 38 operates, the wire gathering mechanism 37 moves towards and away from the press punch 32 as indicated by arrows E. In order to prevent the wire gathering rod 44 from interfering with the press punch 32 and a lower die, the gathering rod 44 is urged by a spring 43 which is normally unloaded and held in free state. The arrangement is such that, as the air cylinder 38 operates, the wire gathering mechanism 37 is moved towards the press punch 32 so that the wires in the vicinity of the guide plate 35 are pushed up by the gathering rod 44 and are moved along the guide ramp 42 of the gathering plate 41 to the position just under the press punch 32, i.e. just above the U-shaped guide groove 35'. In FIG. 6, the reference numeral 40 denotes a pivot shaft which supports the wire connecting plate 41, while a numeral 46 designates a detecting punch which is adapted to detect any failure in the connecting piece before the solderless connecting operation, i.e. before the operation of the press punch 32. The taping section 5 employs a known taping device which receives the wires from the solderless connecting section 4 and conducts a taping on the connecting portion of the wires.

The connecting apparatus of the invention having the construction heretofore described operates in a manner explained hereinbelow.

Referring to FIGS. 1 and 2, a starting switch (not shown) is turned on after a manual insertion of the main wire 1 into the stripping section 3. As a result, the stripper 21 performs its task described before to partially expose the conductor of the main wire 1 at the desired intermediate portion of the latter. Then, one or more branch wires 2 which are beforehand stripped at their ends are inserted to lay along the main wire 1 such that the stripped portion of the main wire 1 and those of the branch wires 2 are aligned with each other. In the event that the branch wires are inserted to come out of a predetermined allowable region of the position, such branch wires are made to contact with the detecting groove 25 so that the detecting circuit is completed to provide a mis-insertion signal thereby to inform the operator of the insertion failure of the branch pipes to enable the operator to correct the insertion. Subsequently, as an automatic operation switch (not shown) is turned on, the main wire 1 and the branch wires 2 inserted into the stripping section 3 are clamped by the fixing claws 29 of the holders 22 and 23. At the same time, the transportation arm section 6 is swung downwardly from the neutral position shown by full line in FIG. 1 as indicated by an arrow until it is stopped at a position indicated at a numeral 6' and shown by broken line in FIG. 1 while extending its transportation arm 12. At this position, the transportation arm section 6 make its clamps 14L and 14R clamp the wires in the stripping section 3 from the upper side of the wires. Then, the fixing claws 29 are opened while the transportation hand means 6 is swung upwardly as indicated by an arrow B while retracting its arm to reach a position indicated at a numeral 6'' where it delivers the wires to the solderless connecting portion 4. Subsequently, the wire gathering mechanism performs the described task to gather the wires correctly at the lower side of the press punch 32. Then, the press punch 32 is lowered to press the connecting piece 31 onto the exposed portions of the wires thereby to connect the wires in a solderless manner. At the same time, the connecting piece 31 is severed from the connecting web 30. After the completion of the solderless connection in the manner described, the transportation hand means 6 which has been stationed at the position 6'' clamps the wires again and is swung downwardly as indicated by arrows C to transfer the wires to the taping section 5. The transportation arm section 6 is then returned to the neutral position without delay.

The taping section 5 conducts taping on the exposed conductors of the wires after the solderless connection, and sends the wires as indicated by an arrow D to a chute which is disposed at a rear portion of the apparatus, thereby to complete the solderless connection of the branch wires 2 to the main wire 1. In the meantime, the stripping section 3 receives the next combination of wires, and the transportation arm section 6 starts its operation again immediately after the resetting to the neutral position, thereby to continue the connecting operation.

As has been described, with the connecting apparatus of the invention, it is possible to realize a through process including the steps of stripping, solderless connection and taping which are combined in a manner to permit a high efficiency of production. In addition, since the transportation hand swings while suitably extending or retracting its arm, the wires are transported at high speed from one to the next step along the paths of minimal distances. Consequently, the tact of the work for connecting the branch wires is considerably improved and the required number of man hour is largely decreased so that the efficiency of the production is remarkably increased as compared with the conventional system which employs different and independent devices for three independent steps of stripping, solderless connection and taping.

Furthermore, the invention provides advantages also in the view point of production management, such as decrease of the transportation steps, prevention of stagnation of the works and a reduction in the number of the half-down works, thanks to the concentration and automation of the reductions steps. Moreover, in the connecting apparatus of the invention, the possibility of production of unacceptable goods and other troubles is minimized, partly because of the three-dimentional arrangement of the uppermost stripping section, intermediate solderless connecting section and the lowermost taping section, and partly because of the provisions of the detecting groove 25 which detects an initial misinsertion of wires and the wire gathering mechanism 37 which operates to gather the wires correctly at the solderless connecting section. This arrangement also affords an easy observation of the operation of the whole apparatus and, hence, a prompt recovery of the operation even in the event of a trouble which may occur seldom.

What is claimed is:

1. An apparatus for connecting at least one branch electric wire to an intermediate portion of a main electric wire, comprising: a stripping section including an insulating stripping apparatus for removing a portion of the insulation from the main electric wire disposed at the front middle portion of the apparatus, said means for stripping comprising means for gripping the main branch wire on either side of the stripping section and stripping means for severing the insulation and removing it from a section of the wire core and means for receiving a stripped end of a branch electric wire, a solderless connecting section disposed at the rear upper portion of the apparatus for applying a solderless connector to the stripped main electric wire and one end of a stripped branch wire in said solderless connecting section, a taping section comprising means for taping the thus solderless connected main and branch wires in the taping section disposed at the rear lower portion of the apparatus, and a transportation hand means having wire gripping means and supported for pivotal and forward and rearward movement for transporting and delivering said wires from said stripping section to solderless connecting section and from said solderless connecting section to said taping section, and detecting means for detecting the presence of the stripped end of the one branch wire in proximity to the stripped portion of the main electric wire in the stripping section.

2. An apparatus for connecting at least one branch electric wire to an intermediate portion of a main electric wire, comprising: a stripping section including an insulating stripping apparatus for removing a portion of the insulation from the main electric wire disposed at the front middle portion of the apparatus, a solderless connecting section disposed at the rear upper portion of the apparatus for applying a solderless connector to the stripped main electric wire and one end of a stripped branch wire in said solderless connecting section, a taping section comprising means for taping the thus solderless connected main and branch wires in the taping section disposed at the rear lower portion of the apparatus, and a transportation hand means having wire gripping means and supported for pivotal and forward and rearward movement for transporting and delivering said wires from said stripping section to solderless connecting section and from said solderless connecting section to said taping section, the means for applying the solderless connector in said solderless connecting section comprising means for feeding a plurality of solderless connectors into the solderless connecting section, means for transferring a main wire and a branch wire into proximity to the connecting means and means for affixing the connecting means to the bare portion of the wires of the main electric wire and the branch electric wire.

3. An apparatus as set forth in claim 2 further including gathering means for gathering the main wire and the branch wire from the transporation hand means and for delivering it into proximity with the solderless connector.

4. An apparatus as set forth in claim 3 wherein the gathering means comprises a movable element having an inclined surface adapted to cooperate with an inclined surface in the solderless connecting section for transferring the wires into proximity with the solderless connector.

5. An apparatus as set forth in claim 2 wherein the taping means in the taping section comprises means for applying tape to the connected wires.

6. An apparatus as set forth in claim 5 wherein the means for stripping in the stripping section comprises means for gripping the main branch wire on either side of the stripping section and stripping means for severing the insulation and removing it from a section of the wire core.

7. An apparatus as set forth in claim 6 wherein the stripping section further includes means for receiving a stripped end of a branch electric wire.

8. An apparatus as set forth in claim 7 further including detecting means for detecting the presence of the stripped end of the one branch wire in proximity to the stripped portion of the main electric wire in the stripping section.

9. An apparatus as set forth in claim 8 wherein the means for applying the solderless connector in the solderless connecting section comprises means for feeding a plurality of solderless connectors into the solderless connecting section, means for transferring a main wire and a branch wire into proximity to the connecting means and means for affixing the connecting means to the bare portion of the wires of the main electric wire and the branch electric wire.

10. An apparatus as set forth in claim 9 further including gathering means for gathering the main wire and the branch wire from the transportation hand means and for delivering it into proximity with the solderless connector.

11. An apparatus as set forth in claim 10 wherein the gathering means comprises a movable element having an inclined surface adapted to cooperate with an inclined surface in the solderless connecting section for transferring the wires into proximity with the solderless connector.

* * * * *